US006684702B2

(12) United States Patent
Ziada

(10) Patent No.: US 6,684,702 B2
(45) Date of Patent: Feb. 3, 2004

(54) METHOD OF DETECTION OF FLOW DUCT OBSTRUCTION

(75) Inventor: Samir Ziada, Dundas (CA)

(73) Assignee: McMaster University, Ontario (CA)

( * ) Notice: Subject to any disclaimer, the term of this patent is extended or adjusted under 35 U.S.C. 154(b) by 2 days.

(21) Appl. No.: 10/112,907

(22) Filed: Mar. 28, 2002

(65) Prior Publication Data

US 2003/0183010 A1 Oct. 2, 2003

(51) Int. Cl.[7] ..... G01N 29/00

(52) U.S. Cl. ..... 73/587; 73/40.5 A; 73/600; 73/602

(58) Field of Search ..... 73/587, 37, 627, 73/40.5 A, 40.7, 1.82, 599, 600, 602

(56) References Cited

U.S. PATENT DOCUMENTS

| | | | | | |
|---|---|---|---|---|---|
| 3,903,729 | A | * | 9/1975 | Covington | 73/40.5 R |
| 4,289,019 | A | * | 9/1981 | Claytor | 73/40.5 A |
| 6,035,696 | A | * | 3/2000 | Kiefer et al. | 73/1.82 |
| 6,116,095 | A | * | 9/2000 | Radle | 73/861.01 |
| 6,480,793 | B1 | * | 11/2002 | Martin | 702/45 |
| 6,507,790 | B1 | * | 1/2003 | Radomski | 702/39 |
| 6,543,282 | B1 | * | 4/2003 | Thompson | 73/204.15 |
| 2002/0035437 | A1 | | 3/2002 | Tingley | 702/51 |

FOREIGN PATENT DOCUMENTS

| | | |
|---|---|---|
| FR | 2 584 192 A | 1/1987 |
| GB | 2 191 860 A | 12/1987 |

OTHER PUBLICATIONS

US 2003/0033879, Adewumi et al., Blockage detection method and associated system.*

Qunli, Wu, Reconstruction of Blockage in a Duct from Single Spectrum, Applied Acoustics, 1994, vol. 41, No. 3, pp. 229–236.

Desalis, M.H.F, Oldham, D.J., The Development of a Rapid Single Spectrum Method for Determining the Blockage Characteristics of a Finite Length Duct, Journal of Sound and Vibration, Jun. 14, 2002, vol. 243, No. 4, pp. 625–640.

Johnston, J.P., Schmidt, W.E., Measurement of Acoustic Reflection from an Obstruction in a Pipe with Flow, J. Acoust. Soc. Am. vol. 63, No. 5, May 1978.

* cited by examiner

*Primary Examiner*—Hezron Williams
*Assistant Examiner*—Jacques Saint-Surin
(74) *Attorney, Agent, or Firm*—William J. Sapone; Coleman Sudol Sapone, P.C.

(57) ABSTRACT

A method for detecting an obstruction in a flow duct is provided. The method includes the steps of directing gas through at least one port of the flow duct, measuring a flow noise level of the gas directed through the at least one port, and comparing the noise level with a predetermined noise level. In the event that the flow noise level exceeds the predetermined noise level by at least a threshold amount, then the method includes the step of indicating the presence of an obstruction in the at least one port.

11 Claims, 6 Drawing Sheets

METHOD OF DETECTION OF FLOW DUCT OBSTRUCTION

FIELD OF THE INVENTION

This invention relates to obstruction detection in flow ducts and in particular to a method for detecting an obstruction in an exhaust manifold.

BACKGROUND OF THE INVENTION

Conventional exhaust manifolds used in automobile manufacturing, for example, are cast using known sand casting methods. As a result, many exhaust manifolds that are produced are blocked or partially blocked by entrapped metal or other material such as sand. Thus, each exhaust manifold is tested for blockage or partial blockage that results from the production process.

One known method of testing for an obstruction includes the use of a ball bearing. The ball bearing is dropped in one end of a port of the manifold and falls by gravity through the manifold and out the opposite end of the port. Each port of the manifold is tested successively. This method suffers from many disadvantages. For example, dropping a ball bearing through each port is time consuming by manufacturing standards. Also, a partial blockage may not be detected depending on the size of the ball bearing and the location of the blockage.

Exhaust manifolds are also tested by connecting a blower to one end of a port, capping all other ports except the port that is being tested for blockage, and measuring back pressure near the blower. An obstruction is detected by comparing the back pressure to a reference value determined from similar, but unobstructed ports. Each port of the manifold is tested successively using this method. While this testing method has achieved extensive use, it suffers from the disadvantage that small obstructions are often undetected because they cause indiscernible changes in the back pressure.

Accordingly, it is an object of an aspect of the present invention to provide a method and apparatus for detection of blockage or partial blockage of an exhaust manifold that mitigates at least some of the disadvantages of the prior art.

SUMMARY OF THE INVENTION

In an aspect of the present invention, there is provided a method for detecting an obstruction in a flow duct. The method includes the steps of directing gas through at least one port of the flow duct, measuring a flow noise level of the gas directed through the at least one port, and comparing the noise level with a predetermined noise level. In the event that the flow noise level exceeds the predetermined noise level by at least a threshold amount, then the method includes the step of indicating the presence of an obstruction in the at least one port.

In another aspect of the present invention, the flow duct is an exhaust manifold.

Advantageously, the present invention provides a fast and reliable method of detecting an obstruction in a flow duct, and in particular in an exhaust manifold. The present invention can be integrated into current automotive manufacturing production lines and can be fully automated.

BRIEF DESCRIPTION OF THE DRAWINGS

The present invention will be better understood with reference to the accompanying drawings, in which.

DESCRIPTION OF THE PREFERRED EMBODIMENT(S)

Figure 1:
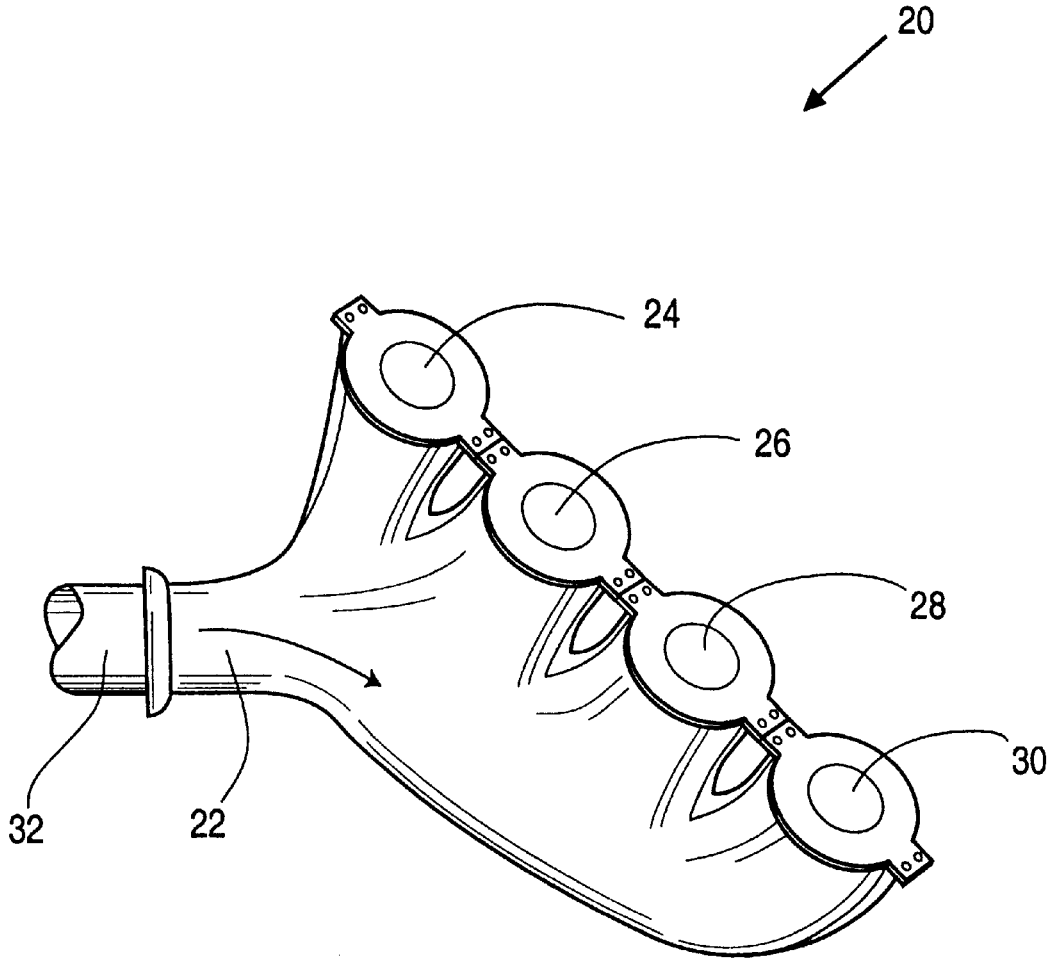
Figure 1 (Prior Art)
FIG. 1 is an automobile exhaust manifold of the prior art.

Reference is first made to FIG. 1, an automobile exhaust manifold of the prior art indicated generally by the numeral 20 in order to describe a preferred embodiment of the apparatus for detecting an obstruction in a flow duct. The exhaust manifold 20 includes an exhaust outlet 22 and four exhaust ports, a first port 24, a second port 26, a third port 28 and a fourth port 30.

Figure 2:
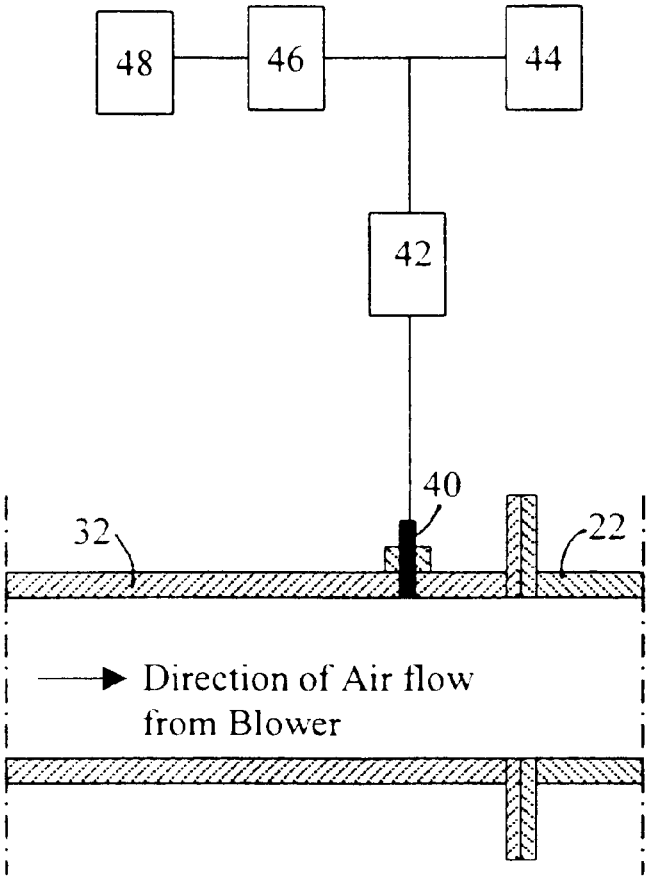
FIG. 2 shows a test apparatus according to an embodiment of the present invention.

Referring now to FIG. 2, the test apparatus includes a blower with a connecting pipe 32 which is connected to the exhaust outlet 22 for forcing air flow through the exhaust manifold 20. A microphone 40 is disposed in a radial hole in the connecting pipe 32 and is fitted flush with the interior surface of the connecting pipe 32, proximal the exhaust manifold 20. The microphone is fitted flush with the interior surface of the connecting pipe 32 to inhibit the introduction of erroneous air flow noise caused by the addition of the microphone. For similar reasons, the connecting pipe 32 to exhaust outlet 22 connection is preferably a smooth transition. In the present embodiment, the microphone 40 is a pressure transducer connected to a power supply and preamplifier 42, which is connected to a frequency analyzer 44 and a mean square (RMS) voltmeter 48 for detecting the level of flow noise. A filter 46 is shown between the RMS voltmeter 48 and the preamplifier 42 and will be discussed below. A suitable microphone is a G.R.A.S. Type 40 BP Pressure Microphone. The microphone has a flat frequency response up to 25 kHz.

The acoustic response of each port (or the noise generated by flow in each port) 24, 26, 28, 30 of the manifold is measured by closing three of the four ports 24, 26, 28, 30 to inhibit flow of air through these ports. Thus, when measurement is carried out on the first port 24, the second, third and fourth ports 26, 28, 30, respectively, are closed by sealing with a gasket and a clamped plate on the open end of each port 26, 28, 30. Similarly, when measurement is carried out on the second port 26, the first, third and fourth ports 24, 28, 30, respectively are closed. It will be appreciated that the third port 28 and fourth port 30 are similarly measured by opening the port to be tested and closing the remaining ports.

The present description is directed to the measurement of the first port 24 for the purpose of simplicity. It is to be understood that each of the procedural steps are repeated for each of the remaining ports.

Figure 3:
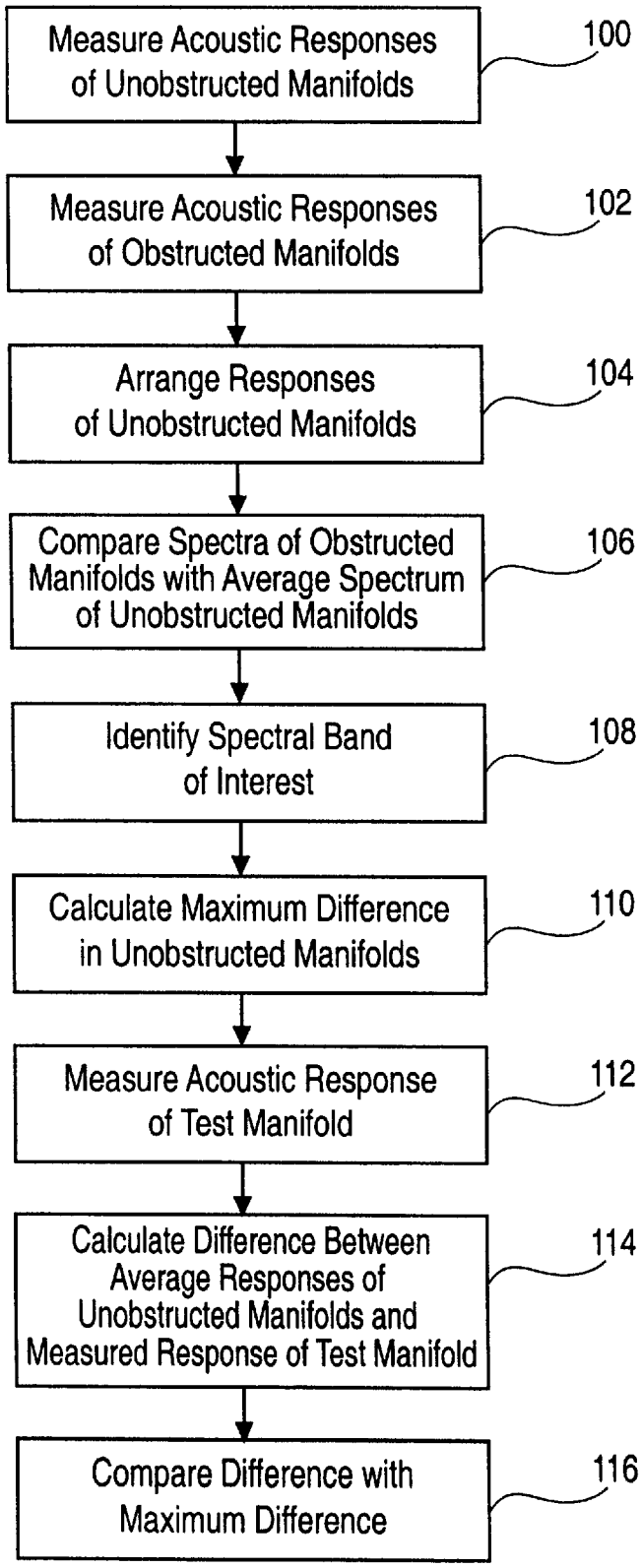
FIG. 3 is a flow chart of a method of detecting a flow duct obstruction according to an embodiment of the present invention.
Figure 4A:
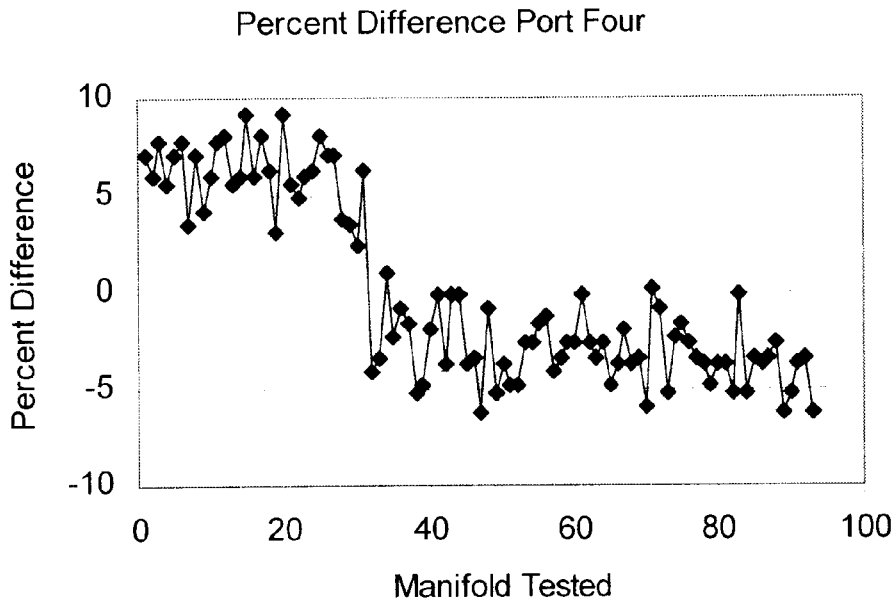
FIGS. 4*a*, 4*b*, 4*c* and 4*d* are graphs showing results of measurement of ninety-three unobstructed manifolds (each figure being for one port), according to an aspect of an embodiment of the present invention.
Figure 4B:
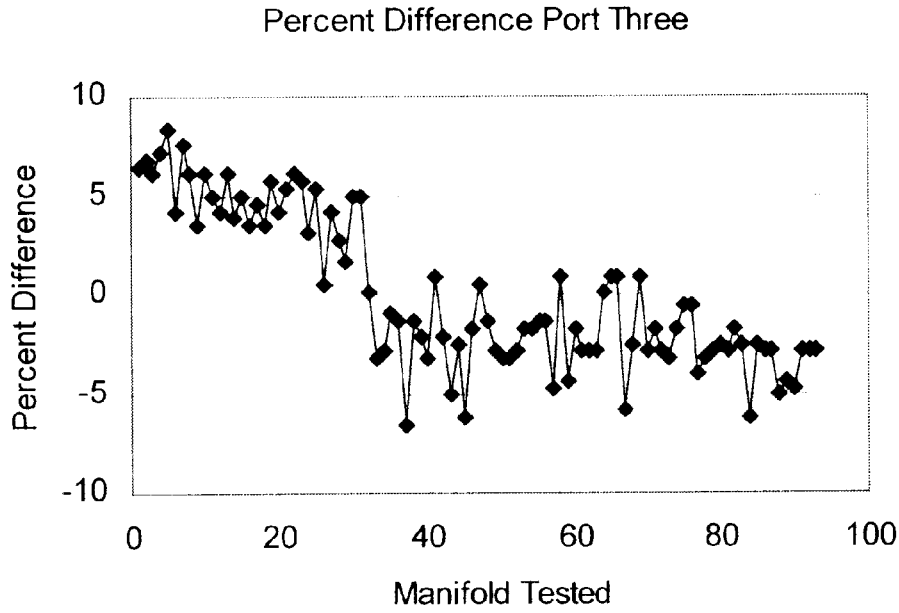
Figure 4C:
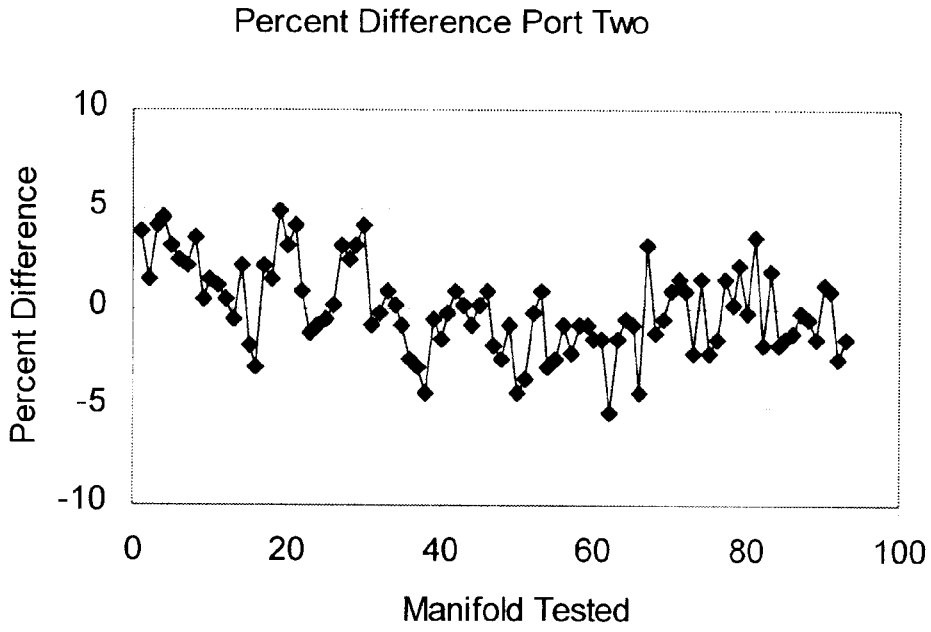
Figure 4D:
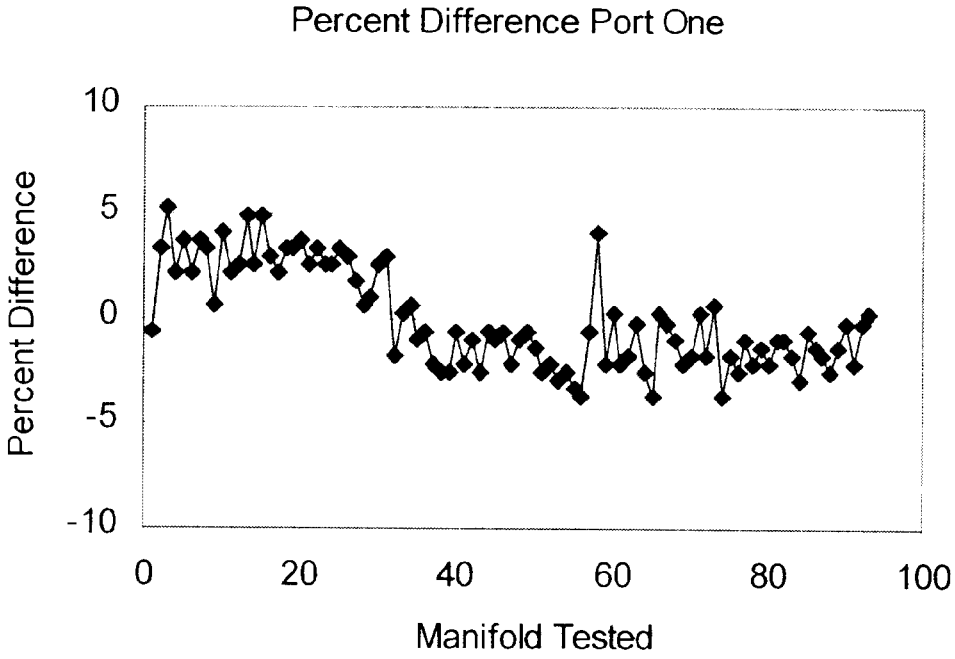

Reference is now made to FIG. 3 to describe a method of detecting a flow duct obstruction according to an embodiment of the present invention. Prior to testing of a manifold (or port of a manifold), the acoustic responses of several manifolds that do not contain obstructions are measured at step 100. In each of these manifolds air is forced through the first port 24 while the remaining ports 26, 28, 30 are closed. The ⅓ octave noise spectra are measured using the microphone 40 and any suitable apparatus yielding ⅓ octave spectra of the microphone signal. The RMS voltage for each ⅓octave is recorded. These measurements are repeated for each port of each unobstructed manifold.

At step 102, the acoustic responses of several manifolds that are known to contain obstructions are measured. In each of these manifolds, air is forced through the first port 24, which contains an obstruction, with the remaining ports 26, 28, 30 being closed and the ⅓ octave noise spectra are measured in a way similar to that mentioned above. The RMS voltage for each ⅓ octave is recorded. These measurements are repeated for each port of each manifold (each port including an obstruction during measurement).

At step 104, the ⅓ octave spectra representing noise of the first port 24 of the manifolds that do not contain an obstruction are averaged. At step 106, the ⅓ octave spectra representing noise of the first ports 24 that contain an obstruction are compared to the averaged spectrum from step 104. Next, a desired frequency range over which an obstruction is identifiable is determined at step 108. It will be understood that this averaging and comparison of the ⅓ octave noise spectra is carried out for each port 24, 26, 28, 30. The desired frequency range is a frequency range over which there is a measurable difference between the output voltages (or the noise levels) of obstructed and unobstructed manifolds. The preferred frequency range is the frequency range at which this difference is maximum. This frequency range is also referred to as the obstruction "imprint" or signature and is determined by experimentation, as will be discussed further below. In the present embodiment, the ⅓ octave band with a center frequency of 4000 Hz is of particular interest. It will be understood that other types of spectra (e.g. one or ⅒ octave spectra) can be used and a procedure similar to that described above will essentially identify the frequency range of interest.

The recorded output voltages representing the noise levels of the first port 24 of the unobstructed manifolds are averaged as described above and the average for the selected frequency range is used as a baseline or control for comparison purposes. At step 110, the maximum noise level difference, or maximum percent deviation from the baseline, is then measured for the first ports 24 of unobstructed manifolds. A similar baseline and maximum noise level difference or deviation is determined for each of the ports of the unobstructed manifolds.

At step 112, testing of a manifold (referred to herein as the test manifold) is carried out in order to detect an obstruction. With the remaining ports closed, a flow of air is forced through the first port 24, from the blower. The microphone and a true RMS voltmeter are used to measure the acoustic response (flow noise level) caused by air flow through the first port 24. A band-pass analog filter 46 is used between the microphone and the voltmeter to discard the noise signal outside the frequency range of interest. Thus, a 3 kHz to 5 kHz band-pass analog filter is preferable as the use of such a filter provides a simpler and faster approach.

For the frequency range of interest, the measured flow noise level in the first port 24 of the test manifold is compared to the averaged output voltage (baseline) of the first ports 24 of the unobstructed manifolds at step 114. The measured flow noise level in the first port 24 of the test manifold is significantly higher than the averaged output voltage (baseline) of the first ports 24 of the unobstructed manifolds when the first port 24 of the test manifold is obstructed. Thus, when the first port 24 of the test manifold is obstructed, the difference between the measured value of the flow noise level in the first port 24 of the test manifold and the averaged value (baseline) of the first ports 24 of the unobstructed manifolds exceeds the maximum noise level difference (deviation) between the baseline and the first ports 24 of the unobstructed manifolds. Therefore the maximum noise level difference (deviation) of unobstructed ports from the baseline is a threshold value for comparison with the difference between the measured response of one port of the test manifold at step 116. As will be appreciated, similar comparisons are made for each of the second, third and fourth ports 26, 28, 30, respectively, in order to determine if there is an obstruction in any of these ports.

The following experimental work and examples are submitted to further illustrate embodiments of the present invention. These examples are intended to be illustrative only and are not intended to limit the scope of the present invention.

EXPERIMENTAL

Initially measurements were taken over a large frequency range and narrow-band spectra were determined from averages of several samples. Also, experimental measurements were carried out using two different blower speeds, 35 Hz and 60 Hz. In order to determine the desired frequency range, the obstructed manifolds were compared to unobstructed manifolds over a frequency range of 0 to 8192 Hz with 1 Hz resolution. The averaged spectra for the obstructed and unobstructed manifolds were examined over ⅓ octave frequency bands, as is standard in acoustics. A positive increase in the spectrum level for each obstructed port, compared to the corresponding unobstructed averaged spectrum was detected at all frequencies between 4000 Hz and 8000 Hz and particularly in the 4000 Hz band for different types of obstructions. It was determined that the percentage increase is sufficiently independent of the blower speed used.

EXAMPLES

The following experiment was carried out using a 3 kHz to 5 kHz band-pass analog filter and the true RMS voltage was amplified using a gain of 20, and recorded. The output voltage was determined for each port of a number of unobstructed manifolds and the output voltages for each port were averaged to create a baseline or control for each port. FIGS. 4*a*, 4*b*, 4*c* and 4*d* show the results of the measurement of ninety-three unobstructed manifolds. Each of these four graphs corresponds to measurements of one of the four ports for all of the ninety-three manifolds and shows the percentage difference (or deviation) between the measured value for each manifold and the calculated average or baseline. It should be noted that the percentage difference is higher for the initial 30 manifolds measured. This was a result of error in measurement and recording and was corrected with experimental experience. The highest difference is less than 10 percent, as shown in each of these Figures.

Figure 5A:
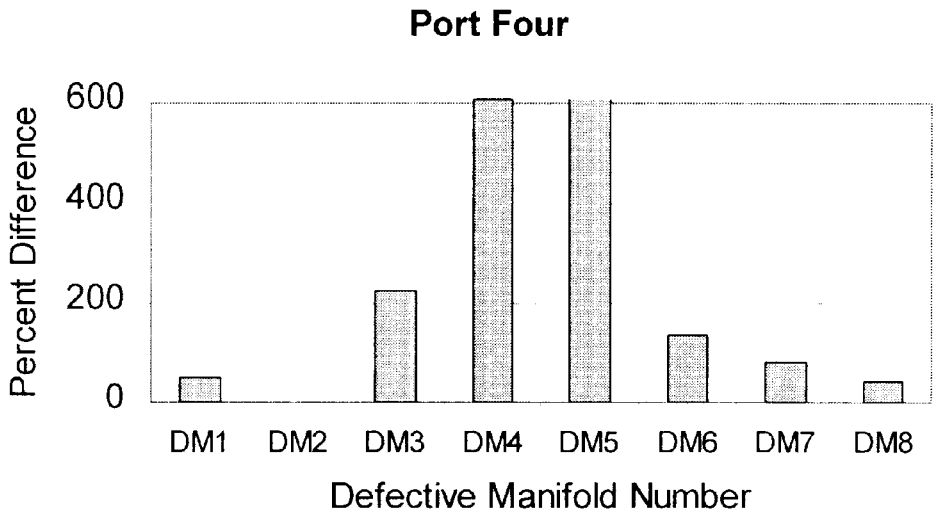
FIGS. 5*a* and 5*b* are graphs showing the results of percentage difference between the value of the RMS voltage for obstructed manifolds and averaged values for unobstructed manifolds according to another aspect of the embodiment of FIGS. 4*a* to 4*d*.
Figure 5B:
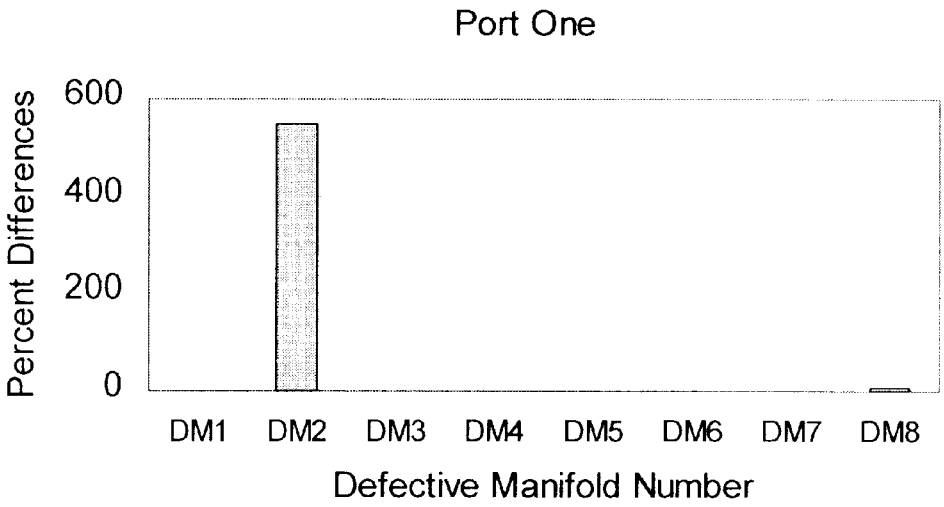

Referring now to FIGS. 5*a* and 5*b*, eight known obstructed manifolds were then tested using the same procedure. FIGS. 5*a* and 5*b* show the percent difference between the value of the RMS voltage measured from the known obstructed manifolds and the averaged value or the baseline for unobstructed manifolds. Note that FIGS. 5*a* and 5*b* correspond to measurements of the fourth and the first port of the manifolds, respectively. No Figures are provided for the second and third ports, as these ports were not obstructed in any of the eight manifolds tested. Note that the fourth port of each of the manifolds, with the exception of the second manifold, was obstructed. Also, the first port of only the second manifold was obstructed. Thus, each of the manifolds with an obstruction showed at least a 44% increase in the measured RMS voltage in the obstructed port and thus the obstruction was easily detected in each of these cases.

The present invention has been described with reference to the preferred embodiment and numerous modifications and changes will occur to those of skill in the art. For example, a band-pass analog filter is not necessary; a digital filter with fixed or adjustable cut-off frequencies can be used or the ⅓ octave method. A fast data acquisition and analysis system can be used to analyze the whole frequency range and then the noise level over the frequency range of interest. Air can flow through the manifold in either direction and the microphone position can differ from that described. The three ports closed during measurement of a port can be closed by means other than a gasket and a clamped plate. Also, the present invention can be used to detect obstructions in other flow ducts and is not limited to an automobile exhaust manifold. Further, other exhaust manifolds with any number of ports can be tested using the present invention. The desired frequency range may also vary. Many other variations and modifications are possible and all such modifications are within the scope and sphere of the present invention as defined by the claims appended hereto.

What is claimed is:

1. A method for detecting an obstruction in a flow duct comprising:

directing gas through at least one port of said flow duct to cause flow of said gas through said at least one port;

measuring a flow noise level of said flow of said gas through said at least one port;

comparing said noise level with a predetermined noise level; and detecting when said flow noise level exceeds said predetermined noise level by at least a threshold amount, then indicating the presence of an obstruction in said at least one port.

2. The method according to claim 1 wherein said predetermined noise level is a predetermined average noise level representative of the noise level of an unobstructed part.

3. The method according to claim 1 wherein said flow duct is an exhaust manifold.

4. The method according to claim 3 wherein each of said steps of directing gas, measuring a flow noise level, comparing said noise level and determining if an obstruction is present are repeated for each port of said manifold for detecting if any one of the ports of said manifold are obstructed.

5. The method according to claim 1 further comprising:

obtaining an acoustic noise spectral analysis on known obstructed and know unobstructed flow ducts prior to measuring said flow noise level to identify a frequency range of interest; and calculating said predetermined noise level by averaging noise levels over said frequency range for said known unobstructed flow ducts.

6. The method according to claim 5 wherein said threshold amount is calculated by determining the maximum difference between said known unobstructed flow ducts and said predetermined noise level.

7. The method according to claim 5 wherein said step of measuring a flow noise level includes filtering for discarding noise above and below said frequency range.

8. The method according to claim 1 wherein said gas is air.

9. The method according to claim 1 wherein said flow noise level is determined by measuring the root mean square amplitude of the noise.

10. The method according to claim 1 wherein said flow noise level is measured using a microphone.

11. The method according to claim 10 wherein said microphone is a pressure transducer.

* * * * *